US008102358B2

(12) United States Patent
Chung et al.

(10) Patent No.: US 8,102,358 B2
(45) Date of Patent: Jan. 24, 2012

(54) SYSTEM AND METHOD FOR INFORMATION HANDLING SYSTEM LCD WHITE BALANCE ALIGNMENT

(75) Inventors: Tze Fung Chung, Singapore (SG); Yee Teck Koh, Singapore (SG)

(73) Assignee: Dell Products L.P., Round Rock, TX (US)

( * ) Notice: Subject to any disclaimer, the term of this patent is extended or adjusted under 35 U.S.C. 154(b) by 1148 days.

(21) Appl. No.: 11/735,527

(22) Filed: Apr. 16, 2007

(65) Prior Publication Data

US 2008/0252589 A1 Oct. 16, 2008

(51) Int. Cl.
*G09G 3/36* (2006.01)

(52) U.S. Cl. ..... 345/102; 345/87; 345/88; 345/89

(58) Field of Classification Search ..... 345/82, 345/87–89, 102, 589, 600, 904, 72, 207, 345/204, 690–694; 362/191, 294, 494, 345; 382/162, 254; 348/273, 229.1, 225.1, 68; 358/1.9

See application file for complete search history.

(56) References Cited

U.S. PATENT DOCUMENTS 4,274,107 A * 6/1981 Tamura et al. ..... 348/225.1
5,408,263 A * 4/1995 Kikuchi et al. ..... 348/68
5,457,494 A * 10/1995 Suga et al. ..... 348/229.1
5,526,058 A * 6/1996 Sano et al. ..... 348/647
6,611,249 B1 * 8/2003 Evanicky et al. ..... 345/102
6,768,815 B2 * 7/2004 Woodall ..... 382/162
6,795,063 B2 * 9/2004 Endo et al. ..... 345/204
6,853,387 B2 * 2/2005 Evanicky et al. ..... 345/690
7,112,806 B2 * 9/2006 Lussier ..... 250/458.1
7,136,076 B2 * 11/2006 Evanicky et al. ..... 345/600
7,405,742 B2 * 7/2008 Evanicky et al. ..... 345/690
7,583,279 B2 * 9/2009 Brown Elliott et al. ..... 345/694
7,592,996 B2 * 9/2009 Brown Elliott et al. ..... 345/102
7,609,880 B2 * 10/2009 Sakashita ..... 382/162
2002/0057374 A1 * 5/2002 Suzuki ..... 348/674
2002/0163529 A1 * 11/2002 Evanicky ..... 345/600
2002/0167637 A1 * 11/2002 Burke et al. ..... 349/161
2004/0239790 A1 * 12/2004 Maeda et al. ..... 348/311
2005/0110740 A1 * 5/2005 Linzmeier et al. ..... 345/102
2005/0225574 A1 * 10/2005 Brown Elliott et al. ..... 345/694
2006/0007406 A1 * 1/2006 Adkins et al. ..... 353/82
2006/0158411 A1 * 7/2006 Sakashita ..... 345/89
2006/0221047 A1 * 10/2006 Tanizoe et al. ..... 345/102
2006/0280360 A1 * 12/2006 Holub ..... 382/162

(Continued)

OTHER PUBLICATIONS http://www.design-software-talk.com/CG_with_Photoshop/1237148-Compensating-for-LCD-Monitor-Brightness: Winkelman, John "Compensating for LCD Monitor Brightness" Design Software Talk, Aug. 29, 2006 (5 pages).

http://www.dl-c.com/discus/messages/2384/3606.html?1096806227:Fantauzzi, Francesco, and Milewski, Ray "Digital Light & Color Message Boards: Caveat on LCD Brightness Setting," Oct. 2, 2004 (1 page).

(Continued)

*Primary Examiner* — Prabodh M Dharia

(74) *Attorney, Agent, or Firm* — Hamilton & Terrile, LLP; Robert W. Holland

(57) ABSTRACT

LCD panel white balance adjustment provides a desired brightness with minimal impact on optical performance by maximizing Red, Green and Blue gains of the LCD panel for a predetermined color temperature and then adjusting brightness with backlight current. For example, Red, Green and Blue gain settings are set at substantially their maximum value to achieve a color temperature of 6500 degrees and then brightness for the LCD panel is adjusted to substantially 200 nits with the gains remaining at maximized values.

9 Claims, 4 Drawing Sheets

U.S. PATENT DOCUMENTS

| | | | | |
|---|---|---|---|---|
| 2007/0085816 | A1* | 4/2007 | Evanicky et al. | 345/102 |
| 2007/0140579 | A1* | 6/2007 | Miyashita | 382/254 |
| 2007/0153256 | A1* | 7/2007 | Liu | 356/30 |
| 2007/0188425 | A1* | 8/2007 | Saccomanno | 345/82 |
| 2007/0279372 | A1* | 12/2007 | Brown Elliott et al. | 345/102 |
| 2008/0186699 | A1* | 8/2008 | Saez et al. | 362/191 |
| 2009/0278867 | A1* | 11/2009 | Brown Elliott et al. | 345/690 |

OTHER PUBLICATIONS http://www.dl-c.com/discus/messages/2384/2623.html?1084130585: Milewski, Ray "Digital Light & Color Message Boards: Brightness Settings on LCD Monitor" May 8, 2004 ( 3 pages).

* cited by examiner

SYSTEM AND METHOD FOR INFORMATION HANDLING SYSTEM LCD WHITE BALANCE ALIGNMENT

BACKGROUND OF THE INVENTION

1. Field of the Invention

The present invention relates in general to the field of information handling system displays, and more particularly to a system and method for information handling system LCD white balance alignment.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

As information handling systems have steadily increased in capabilities over time, information handling system manufacturers have worked to reduce the complexity faced by end users in setting up and using information handling systems. A positive "out of box" experience for the end user improves user satisfaction and also reduces end user inquiries to the manufacturer of the information handling system for technical help, a common source of increased manufacturer cost. As an example, information handling system manufacturers typically load an information handling system with an operating system and applications that automatically configure at the initial power up by the end user. As another example, information handling system manufacturers preset software and hardware components to settings most commonly sought by end users. For instance, portable information handling systems typically include integrated liquid crystal display (LCD) panels that present information as visual images with variable brightness measure in nits. Although LCD panels sometimes have the capability of presenting information at a brightness of 300 to 500 nits, a setting of 200 nits typically provides a comfortable and not too glaring set up brightness for most home and office environments. Thus, to improve the end user out of box experience, LCD panels integrated into portable computers are typically preset at a brightness level of 200 nits even if the preset brightness is less than the maximum brightness capability of the LCD panel.

Typically, in order to preset an LCD panel brightness level, during the factory White Balance adjustment process, the individual Red (R), Green (G) and Blue (B) gain controls are aligned and lowered to achieve both the required color temperature, typically about 6500 degrees, and brightness level, typically about 200 nits. A difficulty that arises with setting brightness by adjusting and aligning R, G and B gain controls is that the LCD panel may not be driven at an optimal condition since LCD panels are typically designed for best performance at full signal gain. For example, the minimum Brightness Uniformity specification of 75% is generally achieved only when the panel is driven with full signal swing without attenuation. However, if gain values are at lower settings, uniformity will be lower than the expected value. With such settings, an end user may detect patches across the display panel screen that detract from optical performances for brightness uniformity, also known as luminance variation, for response time and for viewing angle.

SUMMARY OF THE INVENTION

Therefore a need has arisen for a system and method which performs white balance adjustment with minimal impact on display panel performance.

In accordance with the present invention, a system and method are provided which substantially reduce the disadvantages and problems associated with previous methods and systems for performing white balance adjustment of an LCD panel. LCD panel white balance is performed by setting color gains to the maximum values that provide an appropriate color temperature. Once color gains are set, LCD panel brightness is set by reducing backlight current to provide a predetermined brightness.

More specifically, an information handling system has plural processing components that cooperate to generate visual information. The visual information is presented as visual images with pixels disposed in an LCD panel. A controller manages images presented by the pixels with red, green and blue gain values. An LCD panel settings manager sets the red, green and blue gain to maximum values and then, if necessary, adjusts the gains a minimal amount to present a predetermined color temperature. Once the gains are set to achieve the predetermined color temperature, the brightness of the LCD panel is set to a maximum value by establishing a maximum backlight current, such as a current that results in 200 nits of illumination. The red, green and blue gains and the maximum backlight current are stored in EDID of the LCD panel for reference by the controller as configuration values.

The present invention provides a number of important technical advantages. One example of an important technical advantage is that white balance adjustment is achieved with maximized R, G and B gains for optimal LCD panel performance. Brightness levels with an optimally-configured panel are achieved by lowering lamp current so that luminance variation, response time and viewing angles provide optimal optical performance with appropriate display brightness. Setting brightness levels with lamp current during white balance alignment provides an appropriate end user brightness level without effecting optical performance.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

White balance alignment of an information handling system LCD panel to set maximal Red, Green and Blue gain values and adjust brightness with backlight intensity provides optimal end user display brightness with minimal impact on display optical performance. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
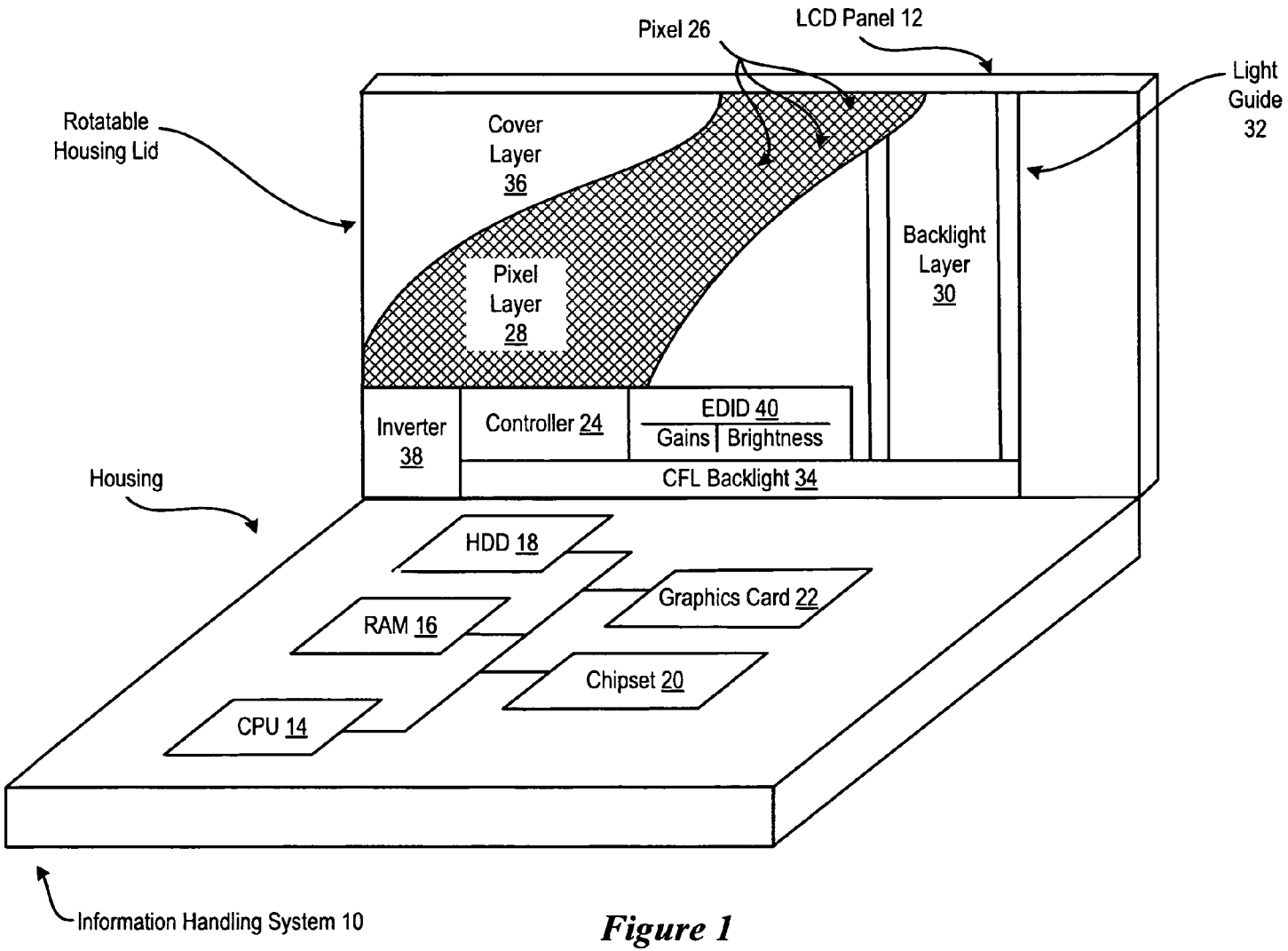
FIG. 1 depicts a block diagram of a portable information handling system having an LCD panel with white balance alignment.

Referring now to FIG. 1, a block diagram depicts a portable information handling system 10 having an LCD panel 12 with white balance alignment. Information handling system 10 has plural processing components that cooperate to generate visual information for presentation as visual images at LCD panel 12, such as a CPU 14, RAM 16, a hard disk drive 18, a chipset 20 which supports firmware operations, and a graphics card 22 which communicates visual information to LCD panel 12. For example, graphics card 22 communicates the visual information to a controller 24, which applies the visual information to present visual images with pixels 26 in a pixel layer 28 of LCD panel 12. Each pixel generates a color by combining varying intensities of red, green and blue light. Red, green and blue light are provided at each pixel from a backlight layer 30 which provides white light through light guides 32 from a backlight 34, such as a cold cathode fluorescent light (CCFL). The white light passes through red, green and blue filters to produce the red, green and blue light, then liquid crystal material at each pixel is selectively altered to allow the desired amount of red, green and blue light pass through a cover layer 36. The translucence of the liquid crystal material at each pixel is altered with current provided by controller 24 based upon the color selected for the pixel from the visual information. Controller 24 also manages the brightness of the image by the amount of current provided from an inverter 38 to backlight 34. Although the backlight depicted in FIG. 1 is a CCFL, in alternative embodiments other forms of backlights may be used, such as LED backlights.

During operation, LCD panel 12 alters pixel characteristics by applying electrical currents managed by controller 24. The response of the liquid crystal material depends upon the gain used by controller 24. Each pixel has a gain setting for red, green and blue colors that control changes to characteristics of the liquid crystal material associated with the red, green and blue filters respectively. During white balance alignment, typically performed at manufacture of an information handling system, the gain values are set so that a nominal color is presented, such as a color temperature of 6500 degrees. The gain values are stored for reference by LCD panel 12, such as in EDID flash memory 40 located at the LCD panel. In order to maximize optical performance of LCD panel 12, the present invention sets the gain values substantially at their maximum values, which typically provides a normal preset color temperature of 6500 degrees. If the desired color temperature is not achieved with all three of the red, green and blue gains set a their maximum values, one or two of the gain values are reduced to achieve the desired color temperature so that the gain values have the maximum value achievable at which the desired color temperature is presented. Setting the red, green and blue gains at maximum values tends to result in a greater amount of backlight passing through the pixels so that brightness at LCD panel 12 is typically too great. To correct for excessive brightness, a backlight current value is store in EDID 40 that limits the current to backlight 34 so that a desired level illumination is presented, such as 200 nits.

Figure 2:
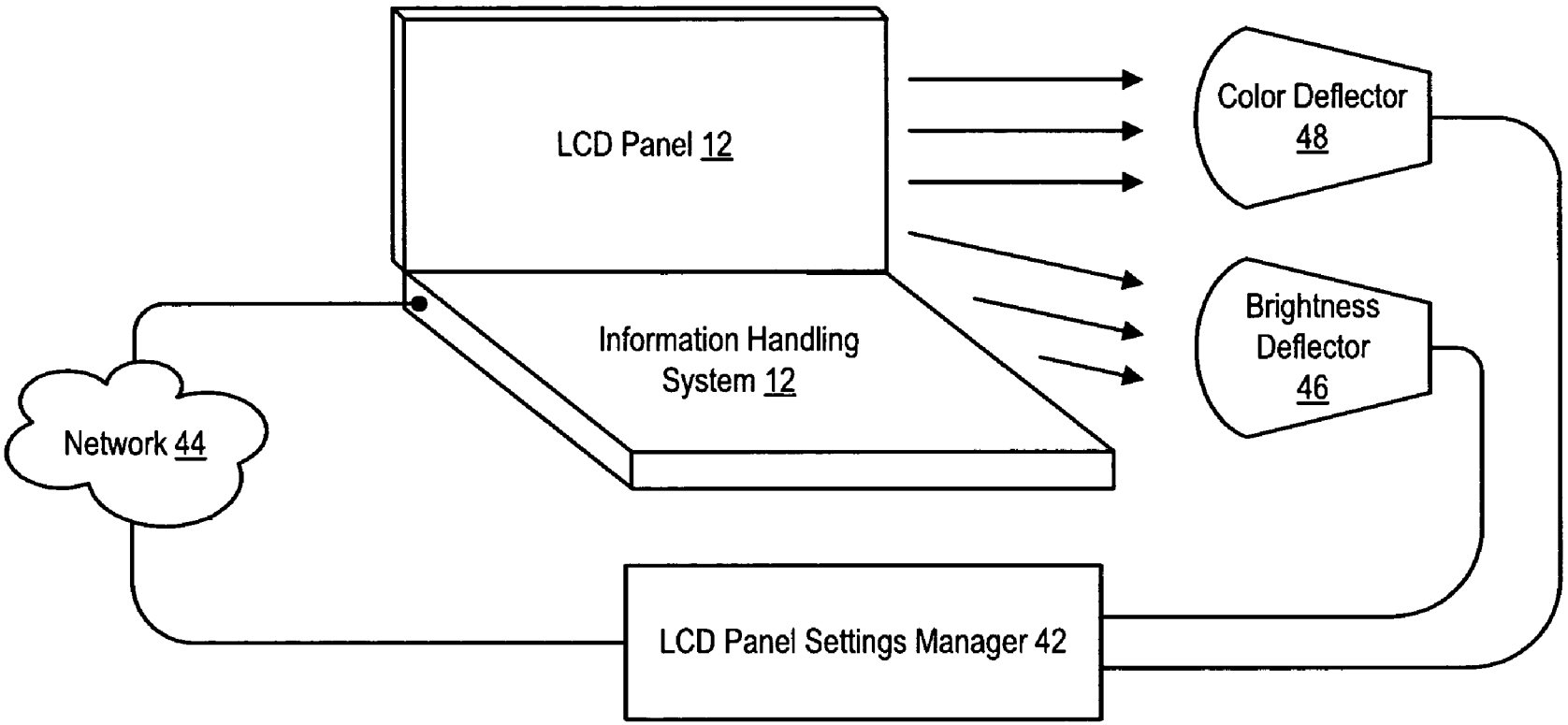
FIG. 2 depicts a block diagram of a system for performing white balance alignment of an information handling system LCD panel.

Referring now to FIG. 2, a block diagram depicts a system for performing white balance alignment of an information handling system LCD panel 12. An LCD panel settings manager 42 interfaces with information handling system 12, such as through a network 44. LCD panel settings manager 42 sets the red, green and blue gains of LCD panel 12 and the maximum current for the backlight brightness of LCD panel 12 during a white balance alignment at manufacture of information handling system 10. As an example, the following table defines optical characteristics of an example LCD panel:

| Parameter | | Symbol | Values Min | Typ | Max | Units |
|---|---|---|---|---|---|---|
| Contrast Ratio | | CR | 700 | 1000 | — | |
| Surface Luminance White | | $L_{WH}$ | 250 | 300 | — | cd/m$^2$ |
| Luminance Variation | | $\delta_{WHITE}$ 9P | 75 | | | % |
| Response Time | Rise Time | $T_{\Gamma R}$ | — | 1.3 | TBD | ms |
| | Decay Time | $T_{\Gamma D}$ | — | 3.7 | TBD | ms |
| Color Coordinates [CIE1931] | Red | Rx | Typ | 0.635 | Typ | |
| | | Ry | −0.03 | 0.342 | −0.03 | |
| | Green | Gx | | 0.292 | | |
| | | Gy | | 0.611 | | |
| | Blue | Bx | | 0.147 | | |
| | | By | | 0.070 | | |
| | White | Wx | | 0.313 | | |
| | | Wy | | 0.329 | | |

-continued

| | Parameter | Symbol | Values Min | Typ | Max | Units |
|---|---|---|---|---|---|---|
| Viewing Angle (CR > 10) | x axis, right (ϕ = 0°) | $\theta^r$ | 70 | 80 | ° | 5 |
| | x axis, left (ϕ = 180°) | θl | 70 | 80 | | |
| | y axis, up (ϕ = 90°) | θu | 60 | 75 | | |
| | y axis, down (ϕ = 270°) | θd | 70 | 85 | | |
| | Gray Scale | | | | | 6 |

Figure 3:
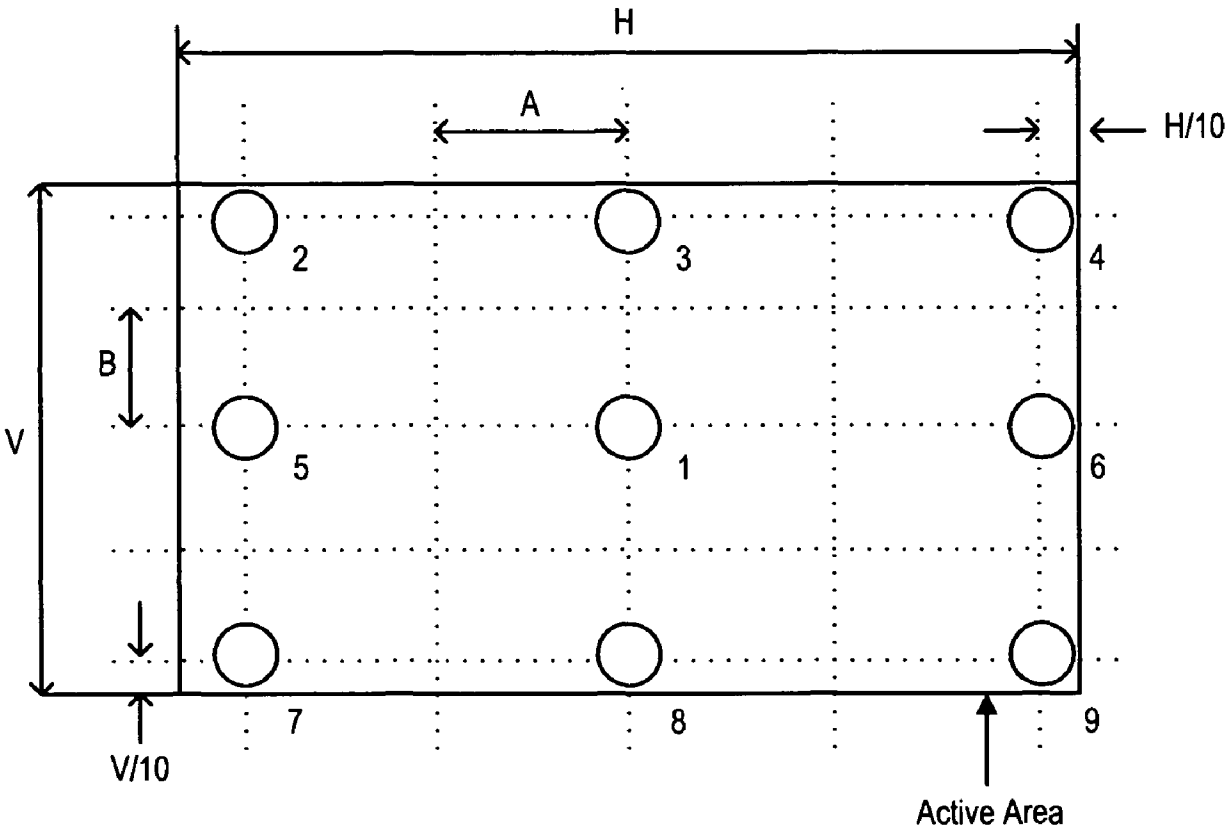
FIG. 3 depicts measuring points of a display panel active area for determining surface luminance.

The variation is surface luminance used for white balance alignment is defined as:

$$\delta_{WHITE} = \frac{\text{Minimum}(L_{on1}, L_{on2} \ldots L_{on9})}{\text{Maximum}(L_{on1}, L_{on2} \ldots L_{on9})} \times 100(\%)$$

where the measuring points one (1) through nine (9) of the active area of the display panel are depicted in FIG. 3. White balance alignment is performed with a brightness detector 46 that detects the brightness or luminance at LCD panel 12 and a color detector 48 that detects the color temperature at LCD panel 12. LCD panel settings manager 42 starts the white balance alignment by setting the red, green and blue gains of LCD panel 12 to their maximum values. At the maximum gain values, the color temperature of LCD panel 12 is compared against a desired color temperature, such as 6500 degrees. If the color temperature needs adjustment, a appropriate reduction is made in one or two of the gain values to achieve the desired color temperature, however, LCD panels default or "Normal Preset" values generally provide close to 6500 degrees of color temperature since the native color temperature of typical LCD panels is approximately 6500 degrees. With the red, green and blue color gains at substantially maximum values, the brightness presented at the LCD panel typically approaches the maximum brightness specification, which generally exceeds the maximum brightness desired by an end user. LCD panel settings manager adjusts the maximum brightness to a desired value, such as 200 nits, by setting a maximum current value for application to the backlight. Once the gains and maximum backlight current are stored in flash memory, the information handling system LCD panel configuration is complete.

Figure 4:
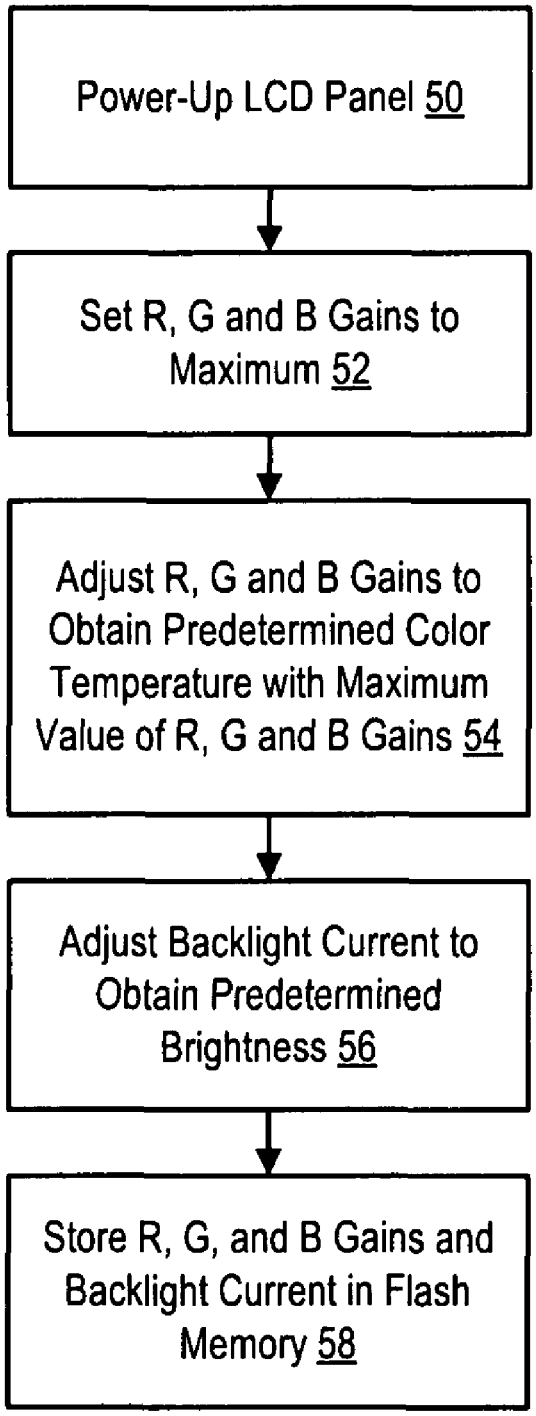
FIG. 4 depicts a flow diagram of a process for performing white balance alignment of an information handling system LCD panel.

Referring now to FIG. 4, a flow diagram depicts a process for performing white balance alignment of an information handling system LCD panel. The process begins at step 50 with power up of the LCD panel. At step 52, the red, green and blue gains of the LCD panel are set to their maximum values. At step 54, the red, blue and green gains are adjusted, if necessary, to obtain the desired color temperature, such as 6500 degrees. The red, blue and green gains are kept at substantially their maximum values, meaning that one or two of the gains are decreased a little as possible to obtain the desired color temperature. At step 56, the backlight current is adjusted to decrease the brightness of the LCD panel to a maximum level, such as 200 nits. At step 58, the red, green and blue gain values and the maximum backlight current level are stored in flash memory of the LCD panel or other permanent memory accessible by the LCD panel, such as in the graphics card. Once the gain and backlight current values are stored, the information handling system applies these stored values at each startup to run the LCD panel.

Although the present invention has been described in detail, it should be understood that various changes, substitutions and alterations can be made hereto without departing from the spirit and scope of the invention as defined by the appended claims.

What is claimed is:

1. An information handling system comprising:

a housing having a rotatable lid;

plural processing components disposed in the housing and operable to generate visual information;

an LCD panel disposed in the lid and interfaced with the processing components, the LCD panel having a backlight and plural pixels, the LCD panel operable to present the visual information as visual images with backlight directed through the pixels;

a controller associated with the LCD panel and interfaced with the pixels, the controller operable to alter the pixels to control backlight that passes through the pixels according to red, green and blue gain settings; and flash memory associated with the controller, the flash memory storing controller settings, the controller settings comprising red, green and blue gain settings that are substantially maximized at a predetermined color temperature and a backlight brightness setting having a predetermined maximum brightness level.

2. The information handling system of claim 1 wherein the color temperature comprises approximately 6500 degrees.

3. The information handling system of claim 1 wherein the backlight brightness predetermined level comprises a maximum current level.

4. The information handling system of claim 1 wherein the backlight brightness predetermined level comprises approximately 200 nits.

5. The information handling system of claim 1 wherein the backlight comprises a cold cathode fluorescent light.

6. A system for performing a white balance alignment of an information handling system LCD panel, the system comprising:

a color detector operable to measure an LCD panel color temperature;

a brightness detector operable to measure an LCD panel brightness;

an LCD panel settings manager interfaced with the color detector and the brightness detector, the LCD panel settings manager operable to configure an LCD panel with a substantially maximum LCD panel R, G, and B gain at a predetermined color temperature and to configure a backlight current by decreasing backlight current to achieve a predetermined maximum brightness level with the maximum R, G and B gains.

7. The system of claim 6 wherein the color temperature comprise approximately 6500 degrees.

8. The system of claim 6 wherein the predetermined brightness level comprises approximately 200 nits.

9. The system of claim 6 wherein the backlight comprises a cold cathode fluorescent light.

* * * * *